US009934728B2

(12) United States Patent
Han et al.

(10) Patent No.: US 9,934,728 B2
(45) Date of Patent: Apr. 3, 2018

(54) FIVE-TRANSISTOR-ONE-CAPACITOR AMOLED PIXEL DRIVING CIRCUIT AND PIXEL DRIVING METHOD BASED ON THE CIRCUIT

(71) Applicant: Shenzhen China Star Optoeletcronics Technology Co., Ltd., Shenzhen (CN)

(72) Inventors: Baixiang Han, Shenzhen (CN); Yuanchun Wu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/633,781

(22) Filed: Jun. 27, 2017

(65) Prior Publication Data

US 2017/0294164 A1 Oct. 12, 2017

Related U.S. Application Data

(63) Continuation of application No. 14/758,565, filed on Jun. 30, 2015, now Pat. No. 9,728,131.

(30) Foreign Application Priority Data

Mar. 16, 2015 (CN) ..... 2015 1 0115455

(51) Int. Cl.

| | |
|---|---|
| ***G09G 3/32*** | (2016.01) |
| ***G09G 3/3258*** | (2016.01) |
| ***G09G 3/3233*** | (2016.01) |
| ***G09G 3/3266*** | (2016.01) |

(52) U.S. Cl.

CPC ..... *G09G 3/3258* (2013.01); *G09G 3/3233* (2013.01); *G09G 3/3266* (2013.01); *G09G 2300/0819* (2013.01); *G09G 2300/0842* (2013.01); *G09G 2320/0233* (2013.01); *G09G 2320/045* (2013.01)

(58) Field of Classification Search

CPC ..... G09G 3/3258; G09G 2320/0233; G09G 2320/045; G09G 2300/0819

USPC ..... 345/82

See application file for complete search history.

(56) References Cited

U.S. PATENT DOCUMENTS

| | | | | |
|---|---|---|---|---|
| 2011/0164071 | A1* | 7/2011 | Chung | G09G 3/3208 345/690 |
| 2013/0016083 | A1* | 1/2013 | Maekawa | G09G 3/3233 345/211 |
| 2014/0071028 | A1* | 3/2014 | Han | G09G 3/3266 345/77 |

* cited by examiner

*Primary Examiner* — Jonathan Blancha

(74) *Attorney, Agent, or Firm* — Leong C. Lei

(57) ABSTRACT

An AMOLED pixel driving circuit has a 5T1C structure, which includes a first, a second, a third, a fourth, and a fifth thin film transistors, a capacitor, and an organic light emitting diode (OLED). The first thin film transistor is a drive thin film transistor. A first global signal, a second global signal, and a scan signal are fed, with various combinations thereof, for various operations of the circuit in an initialization stage, a data writing stage, a threshold voltage compensation stage, and a drive stage. The data writing stage and the threshold voltage compensation stage are carried out simultaneously for effectively compensating threshold voltage variation of the drive thin film transistor and the organic light emitting diode to make the display brightness of the AMOLED uniform and to promote the display quality.

10 Claims, 9 Drawing Sheets

FIVE-TRANSISTOR-ONE-CAPACITOR AMOLED PIXEL DRIVING CIRCUIT AND PIXEL DRIVING METHOD BASED ON THE CIRCUIT

CROSS REFERENCE TO RELATED APPLICATIONS

This is a continuation application of co-pending patent application Ser. No. 14/758,565, filed on Jun. 30, 2015, which is a national stage of PCT Application Number PCT/CN2015/075851, filed on Apr. 3, 2015, claiming foreign priority of Chinese Patent Application Number 201510115455.2, filed on Mar. 16, 2015.

FIELD OF THE INVENTION

The present invention relates to the field of display technology, and more particularly to an AMOLED pixel driving circuit and a pixel driving method.

BACKGROUND OF THE INVENTION

An organic light emitting display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the passive matrix OLED (PMOLED) and the active matrix OLED (AMOLED), i.e. two types of the direct addressing and the thin film transistor (TFT) matrix addressing. The AMOLED comprises pixels arranged in an array and belongs to an active display type, which has high lighting efficiency and is generally utilized for large-scale display devices of high resolution.

The AMOLED is a current driving element. When an electrical current flows through the organic light emitting diode, the organic light emitting diode emits light, and the brightness is determined according to the current flowing through the organic light emitting diode. Most of the known integrated circuits (IC) only transmit voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, a 2T1C pixel driving circuit employed for AMOLED is shown, comprising a first thin film transistor T10, a second thin film transistor T20, and a capacitor C10. The first thin film transistor T10 is a switch thin film transistor and the second thin film transistor T20 is a drive thin film transistor; and the capacitor C10 is a storage capacitor. Specifically, a gate of the first thin film transistor T10 is electrically coupled to a scan signal Scan, and a source is electrically coupled to a data signal Data, and a drain is electrically coupled to a gate of the second thin film transistor T20 and one end of the capacitor C10; a drain of the second thin film transistor T20 is electrically coupled to a power source positive voltage VDD, and a source is electrically coupled to an anode of an organic light emitting diode D; a cathode of the organic light emitting diode D is electrically coupled to a power source negative voltage VSS;

the one end of the capacitor C10 is electrically coupled to the drain of the first thin film transistor T10 and the gate of the second thin film transistor T20, and the other end is electrically coupled to the drain of the second thin film transistor T20 and a power source positive voltage VDD. As the AMOLED displays, the scan signal Scan controls the first thin film transistor T10 to be activated, and the data signal Data enters the gate of the second thin film transistor T20 and the capacitor C10 via the first thin film transistor T10. Then, the first thin film transistor T10 is deactivated. With the storage function of the capacitor C10, the gate voltage of the second thin film transistor T20 can remain to hold the data signal voltage to make the second thin film transistor T20 to be in the conducted state to drive the current to enter the organic light emitting diode D via the second thin film transistor T20 and to drive the organic light emitting diode D to emit light.

The 2T1C pixel driving circuit traditionally employed for the AMOLED is highly sensitive to the threshold voltage of the thin film transistor, the channel mobility, the trigger voltage and the quantum efficiency of the organic light emitting diode and the transient of the power supply. The threshold voltage of the second thin film transistor T20 is that the drive thin film transistor will drift along with the working times. Thus, it results in the luminescence of the organic light emitting diode D being unstable. Furthermore, the drifts of the second thin film transistors T20, i.e. the drive thin film transistors, are different, of which the drift values may be increased or decreased to cause non-uniform luminescence and uneven brightness among the pixels. The traditional 2T1C pixel driving circuit without compensation can result in 50% non-uniform brightness or even higher.

One way to solve the non-uniform AMOLED display brightness issue is to add a compensation circuit to each of the pixels. The compensation means that the compensation has to be implemented to the parameters of the drive thin film transistor, such as threshold voltage or mobility to each of the pixels to make the current flowing through the organic light emitting diode irrelevant with these parameters.

SUMMARY OF THE INVENTION

An objective of the present invention is to provide an AMOLED pixel driving circuit, which can effectively compensate the threshold voltage changes of the drive thin film transistor and the organic light emitting diode to make the display brightness of the AMOLED more even and to raise the display quality.

Another objective of the present invention is to provide an AMOLED pixel driving method, which can effectively compensate the threshold voltage changes of the drive thin film transistor and the organic light emitting diode to make the display brightness of the AMOLED more even and to raise the display quality.

For realizing the aforesaid objectives, the present invention provides an AMOLED pixel driving circuit, comprising: a first thin film transistor, a second thin film transistor, a third thin film transistor, a fourth thin film transistor, a fifth thin film transistor, a capacitor and an organic light emitting diode;

a gate of the first transistor is electrically coupled to the first node, and a drain is electrically coupled to the second node, and a source is electrically coupled to an anode of the organic light emitting diode;

a gate of the second thin film transistor is electrically coupled to a second global signal, and a source is electrically coupled to a power supply positive voltage, and a drain is electrically coupled to the second node;

a gate of the third thin film transistor is electrically coupled to a first global signal, and a source is electrically coupled to the second node, and a drain is electrically coupled to the first node;

a gate of the fourth thin film transistor is electrically coupled to a scan signal, and a source is electrically coupled to a data signal, and a drain is electrically coupled to a third node;

a gate of the fifth thin film transistor is electrically coupled to the second global signal, and a source is electrically coupled to the third node, and a drain is electrically coupled to a reference voltage;

one end of the capacitor is electrically coupled to the third node, and the other end is electrically coupled to the first node;

the anode of the organic light emitting diode is electrically coupled to the source of the first thin film transistor, and a cathode is electrically coupled to a power source negative voltage;

the first thin film transistor is a drive thin film transistor, and a compensation to a threshold voltage is implemented by shorting the drive thin film transistor to be a diode.

All of the first thin film transistor, the second thin film transistor, the third thin film transistor, the fourth thin film transistor and the fifth thin film transistor are low temperature poly-silicon thin film transistors, oxide semiconductor thin film transistors or amorphous silicon thin film transistors.

Both the first global signal and the second global signal are generated by an external sequence controller.

The first global signal, the second global signal and the scan signal are combined with one another, and correspond to an initialization stage, a data writing stage, a threshold voltage compensation stage and a drive stage one after another; the data writing stage and the threshold voltage compensation stage are simultaneously proceeded and writing of the data signal and compensation of the threshold voltage are accomplished at the same time;

in the initialization stage, the first global signal is high voltage level and the second global signal is high voltage level;

in the data writing stage and the threshold voltage compensation stage, the first global signal is high voltage level and the second global signal is low voltage level, and the scan signal provides pulse signals row by row;

in the drive stage, the first global signal is low voltage level and the second global signal is high voltage level.

A plurality of the AMOLED pixel driving circuits are aligned in array in a display panel, and each AMOLED pixel driving circuit in the same row is electrically coupled to a scan signal input circuit employed for providing the scan signal and a reference voltage input circuit employed for providing the reference voltage via the same scan signal line and the same reference voltage line, respectively; each AMOLED pixel driving circuit in the same column is electrically coupled to an image data input circuit employed for providing the data signal via the same data signal line; each AMOLED pixel driving circuit is electrically coupled to a first global signal control circuit employed for providing the first global signal and a second global signal control circuit employed for providing the second global signal.

The reference voltage is a constant voltage.

The present invention further provides an AMOLED pixel driving circuit, comprising: a first thin film transistor, a third thin film transistor, a fourth thin film transistor, a fifth thin film transistor, a capacitor and an organic light emitting diode;

a gate of the first transistor is electrically coupled to the first node, and a drain is electrically coupled to the second node, and a source is electrically coupled to an anode of the organic light emitting diode;

a gate of the second thin film transistor is electrically coupled to a second global signal, and a source is electrically coupled to a power supply positive voltage, and a drain is electrically coupled to the second node;

a gate of the third thin film transistor is electrically coupled to a first global signal, and a source is electrically coupled to the second node, and a drain is electrically coupled to the first node;

a gate of the fourth thin film transistor is electrically coupled to a scan signal, and a source is electrically coupled to a data signal, and a drain is electrically coupled to a third node;

a gate of the fifth thin film transistor is electrically coupled to the second global signal, and a source is electrically coupled to the third node, and a drain is electrically coupled to a reference voltage;

one end of the capacitor is electrically coupled to the third node, and the other end is electrically coupled to the first node;

the anode of the organic light emitting diode is electrically coupled to the source of the first thin film transistor, and a cathode is electrically coupled to a power source negative voltage;

the first thin film transistor is a drive thin film transistor, and a compensation to a threshold voltage is implemented by shorting the drive thin film transistor to be a diode;

wherein all of the first thin film transistor, the second thin film transistor, the third thin film transistor, the fourth thin film transistor and the fifth thin film transistor are low temperature poly-silicon thin film transistors, oxide semiconductor thin film transistors or amorphous silicon thin film transistors;

wherein both the first global signal and the second global signal are generated by an external sequence controller.

The present invention further provides an AMOLED pixel driving method, comprising steps of:

Step 1, providing an AMOLED pixel driving circuit;

Wherein the AMOLED pixel driving circuit comprises: a first thin film transistor, a second thin film transistor, a third thin film transistor, a fourth thin film transistor, a fifth thin film transistor, a capacitor and an organic light emitting diode;

a gate of the first transistor is electrically coupled to the first node, and a drain is electrically coupled to the second node, and a source is electrically coupled to an anode of the organic light emitting diode;

a gate of the second thin film transistor is electrically coupled to a second global signal, and a source is electrically coupled to a power supply positive voltage, and a drain is electrically coupled to the second node;

a gate of the third thin film transistor is electrically coupled to a first global signal, and a source is electrically coupled to the second node, and a drain is electrically coupled to the first node;

a gate of the fourth thin film transistor is electrically coupled to a scan signal, and a source is electrically coupled to a data signal, and a drain is electrically coupled to a third node;

a gate of the fifth thin film transistor is electrically coupled to the second global signal, and a source is electrically coupled to the third node, and a drain is electrically coupled to a reference voltage;

one end of the capacitor is electrically coupled to the third node, and the other end is electrically coupled to the first node;

the anode of the organic light emitting diode is electrically coupled to the source of the first thin film transistor, and a cathode is electrically coupled to a power source negative voltage;

the first thin film transistor is a drive thin film transistor;

Step 2, entering an initialization stage;

wherein the first global signal provides high voltage level, and the second global signal provides high voltage level; the fourth thin film transistor is off, and all the second, the third, the fifth thin film transistors are on; the first node is written with the power source positive voltage, and the third node is written with the reference voltage;

Step 3, entering a data writing stage and a threshold voltage compensation stage;

wherein the data writing stage and the threshold voltage compensation stage are simultaneously proceeded;

the scan signal provides pulse signals row by row, and the first global signal provides high voltage level, and the second global signal provides low voltage level; the fourth, the third thin film transistors are on, and the second, the fifth thin film transistors are off; the data signal is written into the third node row by row; the gate and the drain of the first thin film transistor are short, and the first thin film transistor is shorted to be a diode, and the first node is discharged to:

$$V_G = VSS + V_{th_T1} + V_{th_OLED}$$

wherein $V_G$ represents a voltage of the first node, and VSS represents the power source negative voltage, $V_{th_T1}$ represents the threshold voltage of the first thin film transistor, which is the drive thin film transistor and $V_{th_OLED}$ represents a threshold voltage of the organic light emitting diode;

Step 4, entering a drive stage;

wherein the first global signal provides high voltage level, and the second global signal provides low voltage level; the third, the fourth thin film transistors are off, and the second, the fifth thin film transistors are on; the third node is written with the reference voltage, and the voltage of the first node, which is the gate voltage of the first thin film transistor is coupled by the capacitor to:

$$V_G = VSS + V_{th_T1} + V_{th_OLED} + Vref - V_{Data}$$

a source voltage of the first thin film transistor is:

$$V_S = VSS + V_{th_OLED} + f(\text{Data})$$

wherein $V_G$ represents a voltage of the first node, which is a gate voltage of the first thin film transistor and $V_{Data}$ represents a data signal voltage, $V_S$ represents the source voltage of the first thin film transistor, f(Data) represent a represents a function related to the data signal;

the organic light emitting diode emits light, and a current flowing through the organic light emitting diode is irrelevant with the threshold voltage of the first thin film transistor and the threshold voltage of the organic light emitting diode.

All of the first thin film transistor, the second thin film transistor, the third thin film transistor, the fourth thin film transistor and the fifth thin film transistor are low temperature poly-silicon thin film transistors, oxide semiconductor thin film transistors or amorphous silicon thin film transistors.

Both the first global signal and the second global signal are generated by an external sequence controller.

The reference voltage is a constant voltage.

The benefits of the present invention are: the present invention provides an AMOLED pixel driving circuit and a pixel driving method. The 5T1C structure pixel driving circuit is utilized to implement compensation to the threshold voltage of the drive thin film transistor and the threshold voltage of the organic light emitting diode in each of the pixels. The writing of the data signal and compensation of the threshold voltage are simultaneously proceeded. The first, the second global signals are employed to control all the pixel driving circuits in the entire panel for effectively compensating the threshold voltage variations of the drive thin film transistor and the organic light emitting diode to make the display brightness of the AMOLED more even and to promote the display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
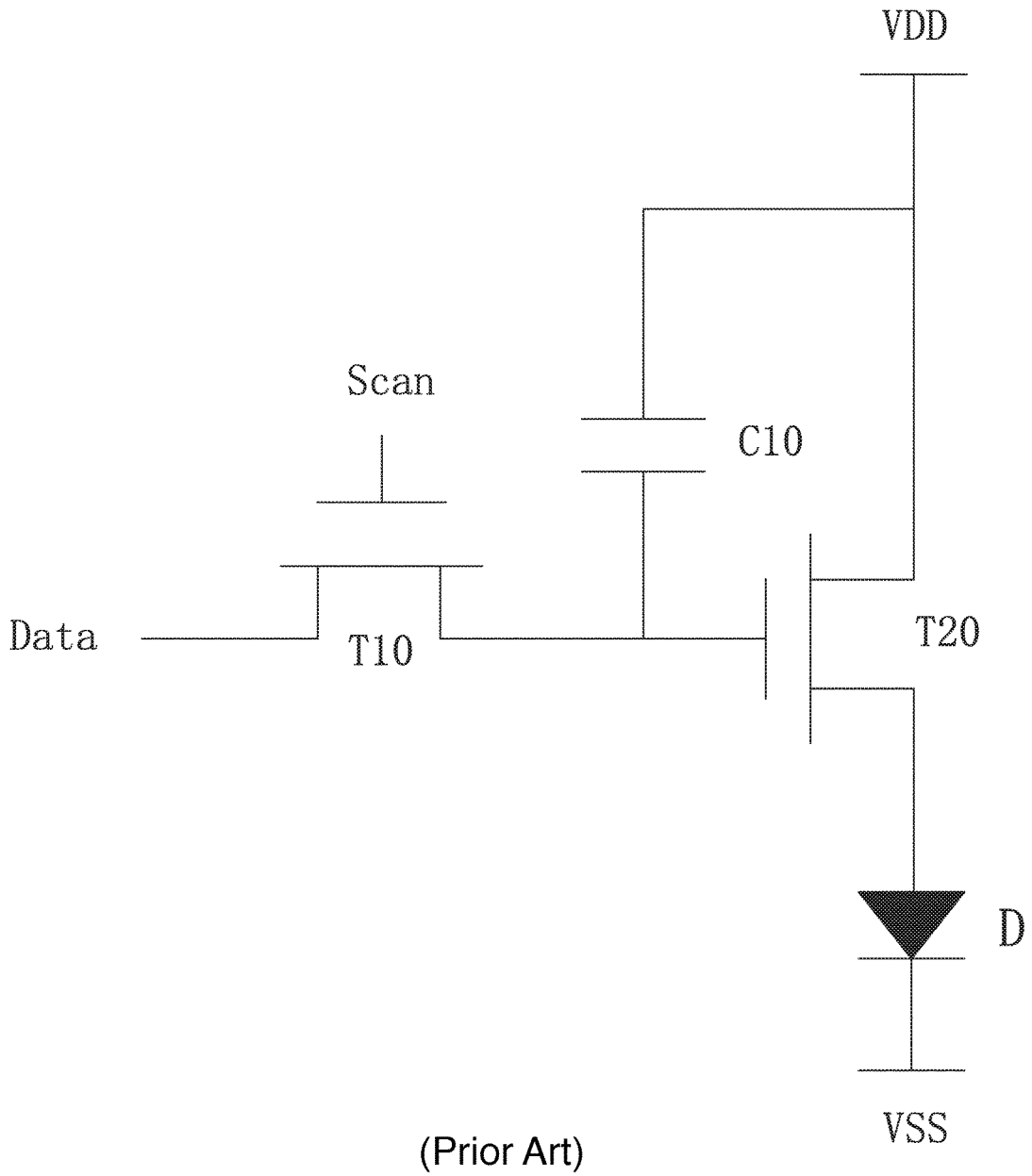
(Prior Art) Fig. 1
FIG. 1 is a circuit diagram of a 2T1C pixel driving circuit employed for AMOLED according to prior art.
Figure 2:
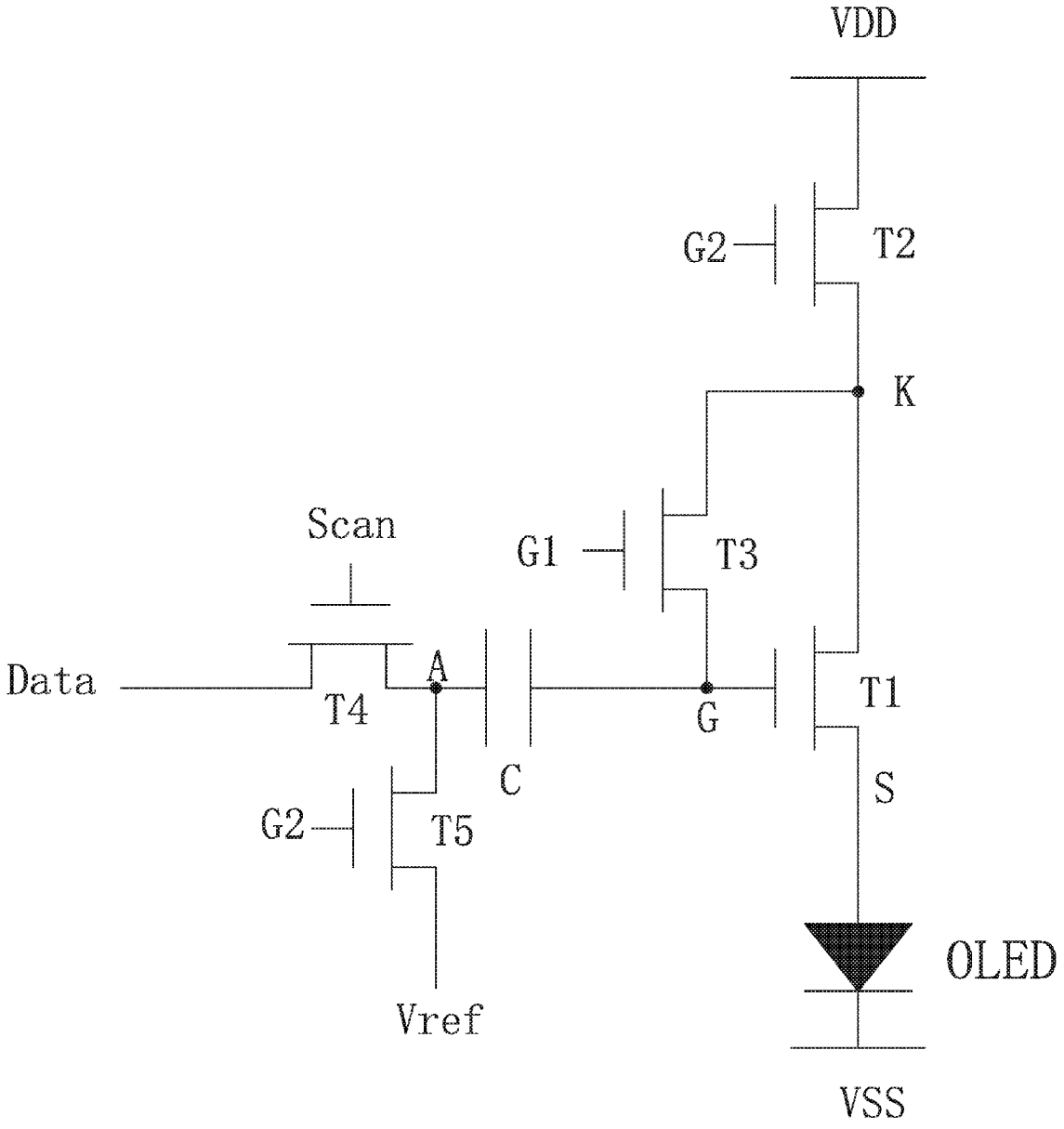
FIG. 2 is a circuit diagram of an AMOLED pixel driving circuit according to the present invention.

Referring to FIG. 2, the present invention provides an AMOLED pixel driving circuit, and the AMOLED pixel driving circuit utilizes a 5T1C structure, and comprises: a first thin film transistor T1, a second thin film transistor T2, a third thin film transistor T3, a fourth thin film transistor T4, a fifth thin film transistor T5, a capacitor C, and an organic light emitting diode OLED.

A gate of the first transistor T1 is electrically coupled to the first node G, and a drain is electrically coupled to the second node K, and a source is electrically coupled to an anode of the organic light emitting diode OLED; a gate of the second thin film transistor T2 is electrically coupled to a second global signal G2, and a source is electrically coupled to a power supply positive voltage VDD, and a drain is electrically coupled to the second node K; a gate of the third thin film transistor T3 is electrically coupled to a first global signal G1, and a source is electrically coupled to the second node K, and a drain is electrically coupled to the first node G; a gate of the fourth thin film transistor T4 is electrically coupled to a scan signal Scan, and a source is electrically coupled to a data signal Data, and a drain is electrically coupled to a third node A; a gate of the fifth thin film transistor T5 is electrically coupled to the second global signal G2, and a source is electrically coupled to the third node A, and a drain is electrically coupled to a reference voltage Vref; one end of the capacitor C is electrically coupled to the third node A, and the other end is electrically coupled to the first node G; the anode of the organic light emitting diode OLED is electrically coupled to the source of the first thin film transistor T1, and a cathode is electrically coupled to a power source negative voltage VSS.

The first thin film transistor T1 is a drive thin film transistor, and compensation to a threshold voltage is implemented by shorting the drive thin film transistor to be a diode.

Figure 7:
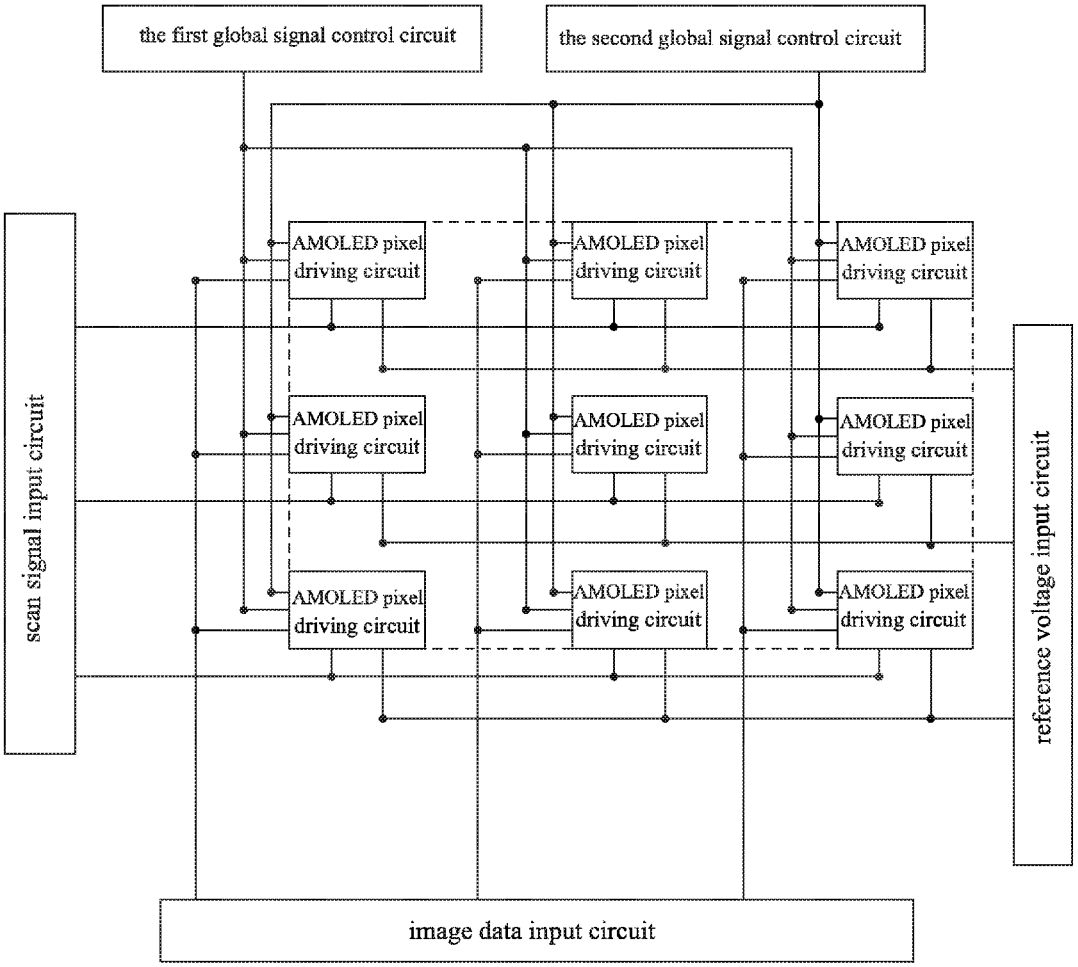
FIG. 7 is a display block diagram of the AMOLED pixel driving circuit according to the present invention applied in a display panel.

Furthermore, referring to FIG. 7, a plurality of the AMOLED pixel driving circuits are aligned in an array in the display panel, and each AMOLED pixel driving circuit in the same row is electrically coupled to a scan signal input circuit employed for providing the scan signal Scan and a reference voltage input circuit employed for providing the reference voltage Vref via the same scan signal line and the same reference voltage line, respectively; each AMOLED pixel driving circuit in the same column is electrically coupled to an image data input circuit employed for providing the data signal Data via the same data signal line; each AMOLED pixel driving circuit is electrically coupled to a first global signal control circuit employed for providing the first global signal G1 and a second global signal control circuit employed for providing the second global signal G2. That is to say, the first global signal G1 and the second global signal G2 function to every single AMOLED pixel driving circuit in the display panel. All the AMOLED pixel driving circuits in the display panel can be controlled with one set of the first global signal G1 and the second global signal G2.

The first global signal G1 is employed to control the activations and deactivations of the third thin film transistor T3; the second global signal G2 is employed to control the activation and deactivation of the second, the fifth thin film transistors T2, T5; the scan signal Scan is employed to control the activation and deactivation of the fourth thin film transistor T4 to realize the scan row by row; the data signal Data is employed to control the brightness of the organic light emitting diode OLED. The reference voltage Vref is a constant voltage.

Specifically, all of the first thin film transistor T1, the second thin film transistor T2, the third thin film transistor T3, the fourth thin film transistor T4 and the fifth thin film transistor T5 are low temperature poly-silicon thin film transistors, oxide semiconductor thin film transistors or amorphous silicon thin film transistors. Both the first global signal G1 and the second global signal G2 are generated by an external sequence controller.

Furthermore, in a display process of one frame of image (1 frame), the first global signal G1, the second global signal G2 and the scan signal Scan are combined with one another, and correspond to an initialization stage 1, a data writing stage 2, a threshold voltage compensation stage 3 and a drive stage 4 one after another. The data writing stage 2 and the threshold voltage compensation stage 3 are simultaneously proceeded and writing of the data signal Data and compensation of the threshold voltage are accomplished at the same time.

In the initialization stage 1, the first global signal G1 is high voltage level and the second global signal G2 is high voltage level; in the data writing stage 2 and the threshold voltage compensation stage 3, the first global signal G1 is high voltage level and the second global signal G2 is low voltage level, and the scan signal Scan provides pulse signals row by row; in the drive stage 4, the first global signal G1 is low voltage level and the second global signal G2 is high voltage level.

In the initialization stage 1, the fourth thin film transistor T4 is off, and all the second, the third, and the fifth thin film transistors T2, T3, T5 are on; the first node G is written with the power source positive voltage VDD, and the third node A is written with the reference voltage Vref; in the data writing stage 2 and the threshold voltage compensation stage 3, the fourth and the third thin film transistors T4, T3 are on, and the second and the fifth thin film transistors T2, T5 are off, and the data signal Data is written into the third node A row by row, and the gate and the drain of the first thin film transistor T1 are short, and the first thin film transistor T1 is shorted to be a diode, and the first node G is discharged; in the drive stage 4, the third and the fourth thin film transistors T3, T4 are off, and the second and the fifth thin film transistors T2, T5 are on, and the third node A is written with the reference voltage Vref, and the voltage of the first node G, i.e. the gate voltage of the first thin film transistor T1 is coupled by the capacitor C, and the organic light emitting diode OLED emits light, and a current flowing through the organic light emitting diode OLED is irrelevant with the threshold voltage of the first thin film transistor T1 and the threshold voltage of the organic light emitting diode OLED.

The AMOLED pixel driving circuit can effectively compensate the threshold voltage changes of the first thin film transistor T1, i.e. the drive thin film transistor and the organic light emitting diode OLED to make the display brightness of the AMOLED more even and to raise the display quality.

Figure 3:
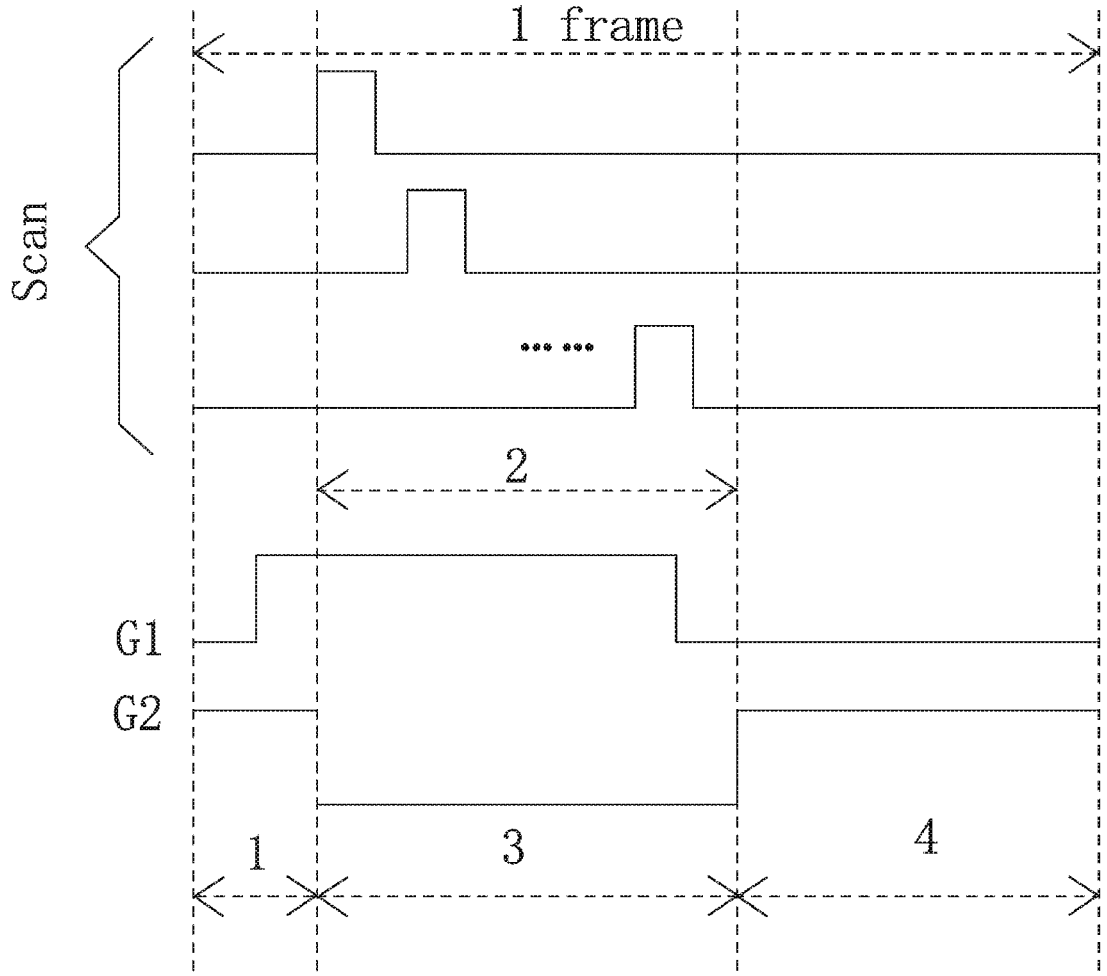
FIG. 3 is a sequence diagram of an AMOLED pixel driving circuit according to the present invention.
Figure 4:
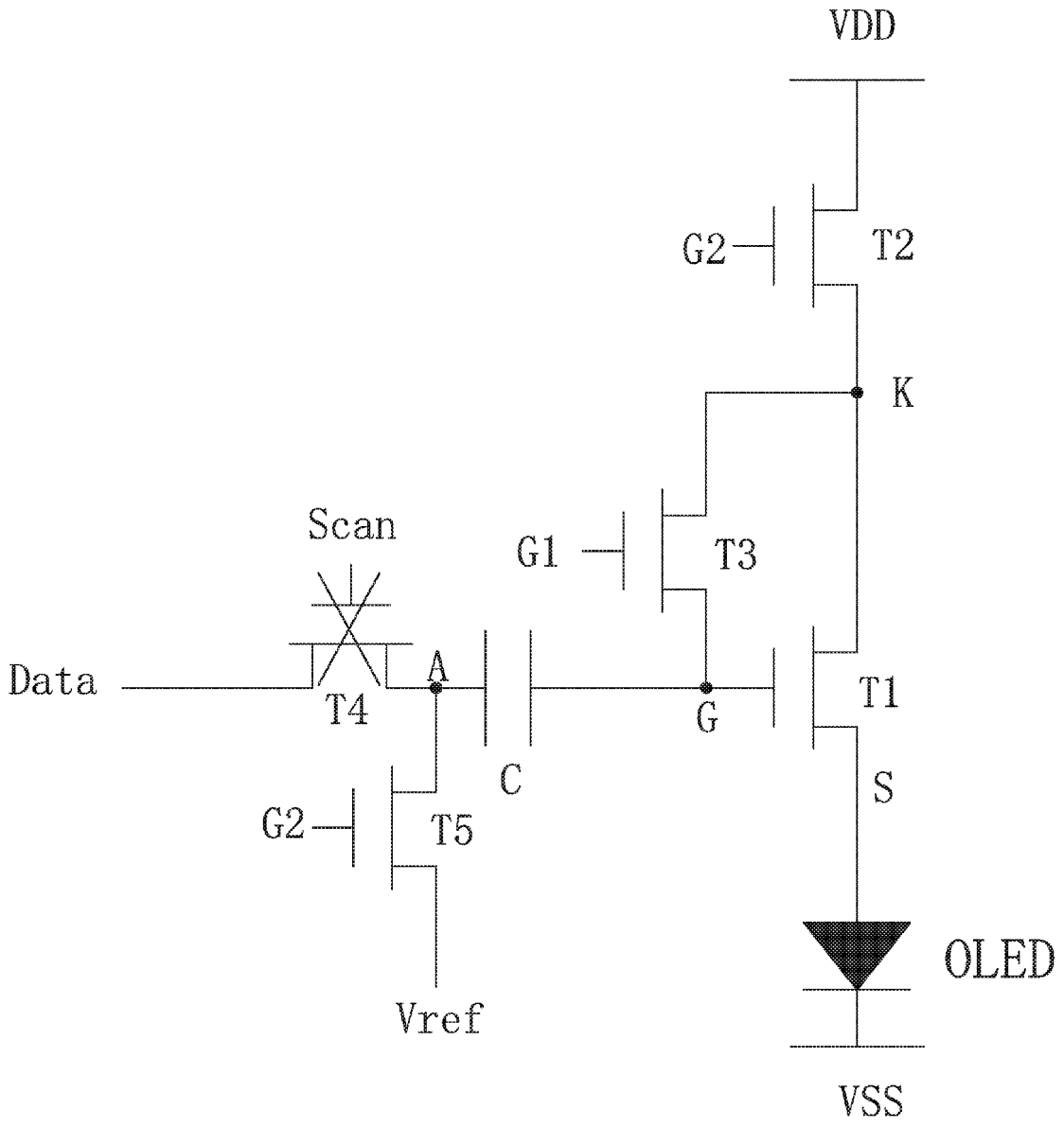
FIG. 4 is a diagram of Step 2 of an AMOLED pixel driving method according to the present invention.
Figure 5:
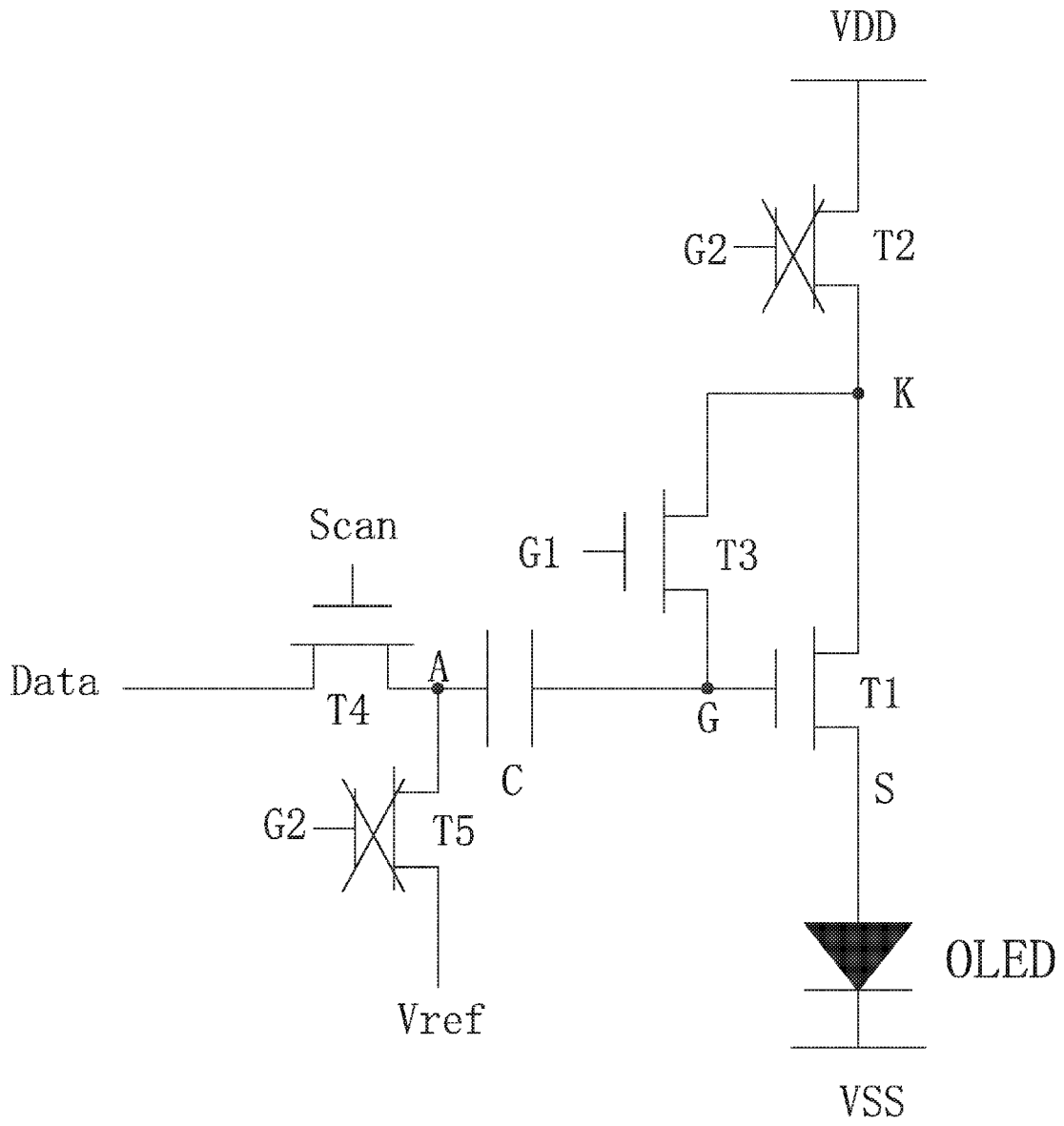
FIG. 5 is a diagram of Step 3 of the AMOLED pixel driving method according to the present invention.
Figure 6:
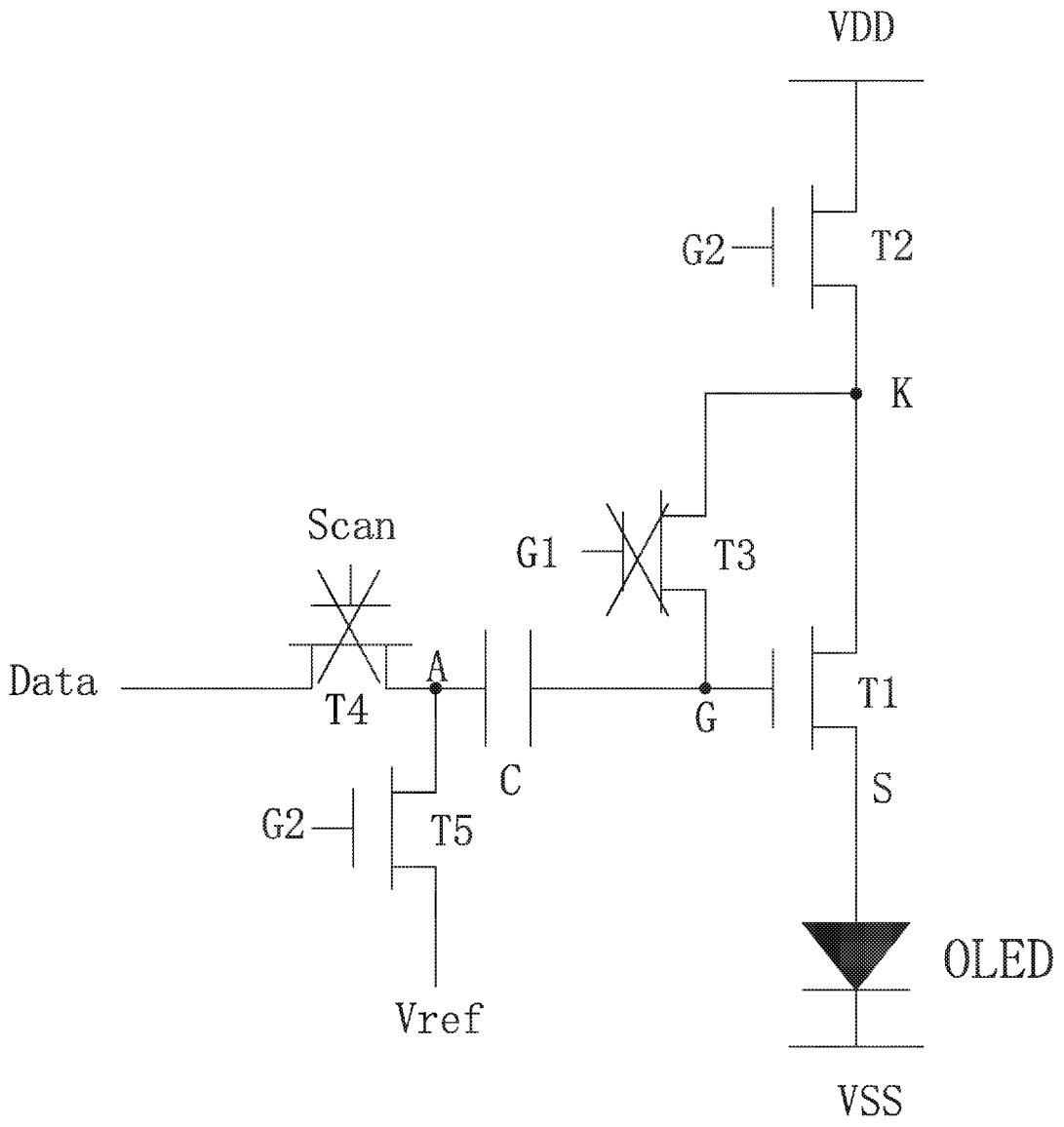
FIG. 6 is a diagram of Step 4 of the AMOLED pixel driving method according to the present invention.

Referring to FIGS. 4-6 in conjunction with FIGS. 2 and 3, on the basis of the aforesaid AMOLED pixel driving circuit, the present invention further provides an AMOLED pixel driving method, comprising steps of:

Step 1, providing an AMOLED pixel driving circuit utilizing the 5T1C structure as shown in the aforesaid FIG. 2, and the description of the circuit is not repeated here.

Step 2, referring to FIGS. 3 and 4, in a display process of one frame of image (1 frame), first, entering an initialization stage 1.

The first global signal G1 provides high voltage level, and the second global signal G2 provides high voltage level; the fourth thin film transistor T4 is off, and all the second, the third, and the fifth thin film transistors T2, T3, T5 are on; the first node G is written with the power source positive voltage VDD, and the third node A is written with the reference voltage Vref.

Step 3, referring to FIGS. 3 and 5, entering a data writing stage 2 and a threshold voltage compensation stage 3. The data writing stage 2 and the threshold voltage compensation stage 3 are simultaneously proceeded for accomplishing the writing of the data signal Data and the compensation of the threshold voltage at the same time.

The scan signal Scan provides pulse signals row by row, and the first global signal G1 provides high voltage level, and the second global signal G2 provides low voltage level; the fourth and the third thin film transistors T4, T3 are on, and the second and the fifth thin film transistors T2, T5 are off; the data signal Data is written into the third node A row by row; the gate and the drain of the first thin film transistor T1 are short, and the first thin film transistor T1 is shorted to be a diode, and the first node G is discharged to:

$$V_G = VSS + V_{th_T1} + V_{th_OLED}$$

wherein $V_G$ represents the voltage of the third node G, and VSS represents the power source negative voltage, and $V_{th_T1}$ represents the threshold voltage of the first thin film transistor T1, i.e. the drive thin film transistor, and $V_{th_OLED}$ represents a threshold voltage of the organic light emitting diode OLED.

Step 4, referring to FIGS. 3 and 6, entering a drive stage 4.

The first global signal G1 provides high voltage level, and the second global signal G2 provides low voltage level; the third and the fourth thin film transistors T3, T4 are off, and the second and the fifth thin film transistors T2, T5 are on; the third node A is written with the reference voltage Vref, and the voltage of the first node G, i.e. the gate voltage of the first thin film transistor T1 is coupled by the capacitor C to:

$$V_G = VSS + V_{th_T1} + V_{th_OLED} + Vref - V_{Data}$$

a source voltage of the first thin film transistor T1 is:

$$V_S = VSS + V_{th_OLED} + f(\text{Data})$$

wherein $V_G$ represents a voltage of the first node G, i.e. a gate voltage of the first thin film transistor T1 and $V_{Data}$ represents a voltage of data signal Data, $V_S$ represents the source voltage of the first thin film transistor T1, f(Data) represent a represents a function related to the data signal Data for showing the influence to the source voltage of the first thin film transistor T1 generated by the data signal Data. People who are skilled in this field can utilize corresponding known functions on demands.

Furthermore, as known, the formula of calculating the current flowing through the organic light emitting diode OLED is:

$$I = 1/2Cox(\mu W/L)(Vgs - V_{th}) \quad (1)$$

wherein I is the current of the organic light emitting diode OLED, and μ is the carrier mobility of drive thin film transistor; and W and L respectively are the width and the length of the channel of the drive thin film transistor; and Vgs is the voltage between the gate and the source of the drive thin film transistor, and Vth is the threshold voltage of the drive thin film transistor. In the present invention, the threshold voltage Vth of the drive thin film transistor, i.e. the threshold voltage $V_{th_T1}$ of the first thin film transistor T1; Vgs is the difference between the voltage of the first node G, i.e. the gate voltage of the first thin film transistor T1 and the source voltage of the first thin film transistor T1, which is:

$$\begin{aligned} Vgs &= V_G - V_S = \quad (2) \\ &= (VSS + V_{th_T1} + V_{th_OLED} + Vref - V_{Data}) - \\ &\quad (VSS + V_{th_OLED} + f(\text{Data})) \\ &= V_{th_T1} + Vref - V_{Data} - f(\text{Data}) \end{aligned}$$

The equation (2) is substituted into equation (1) to derive:

$$\begin{aligned} I &= 1/2Cox(\mu W/L)(V_{th_T1} + Vref - V_{DATA} - f(\text{Data}) - V_{th_T1})^2 \\ &= 1/2Cox(\mu W/L)(Vref - V_{DATA} - f(\text{Data}))^2 \end{aligned}$$

Thus, it can be seen that the current I flowing through the organic light emitting diode OLED is irrelevant with the threshold voltage $V_{th_T1}$ of the first thin film transistor T1, the threshold voltage $V_{th_OLED}$ of the organic light emitting diode OLED and the power source negative voltage VSS to realize the compensation function. The threshold voltage changes of the drive thin film transistor, i.e. the first thin film transistor T1 and the organic light emitting diode OLED can be effectively compensated to make the display brightness of the AMOLED more even and to raise the display quality.

Figure 8:
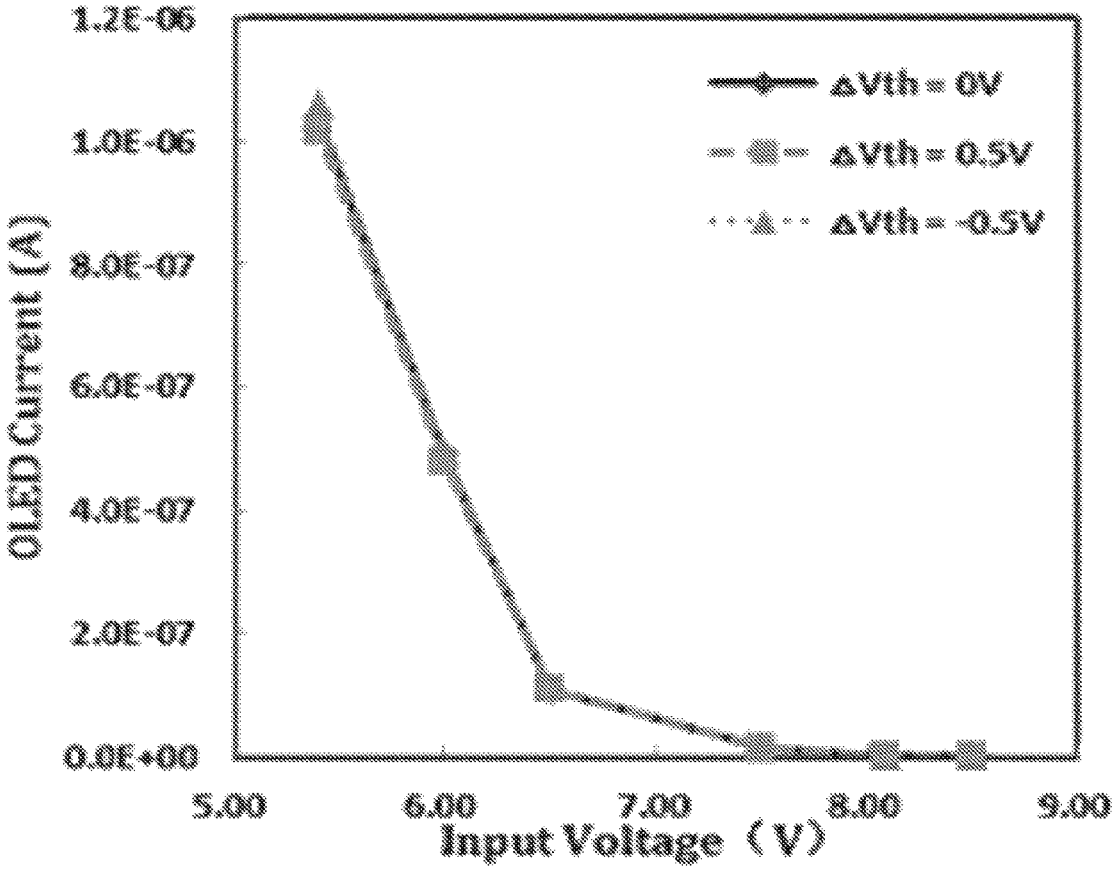
FIG. 8 is a simulation diagram of a current flowing through the OLED as a threshold voltage of the drive thin film transistor in the present invention drifts.

Referring to FIG. 8, as the threshold voltage of the drive thin film transistor, i.e. the first thin film transistor T1 respectively drifts 0V, +0.5V, −0.5V, the change of the current flowing through the organic light emitting diode OLED will not exceed 6%, which effectively ensures the light emitting stability of the organic light emitting diode OLED to make the brightness of the AMOLED more even.

Figure 9:
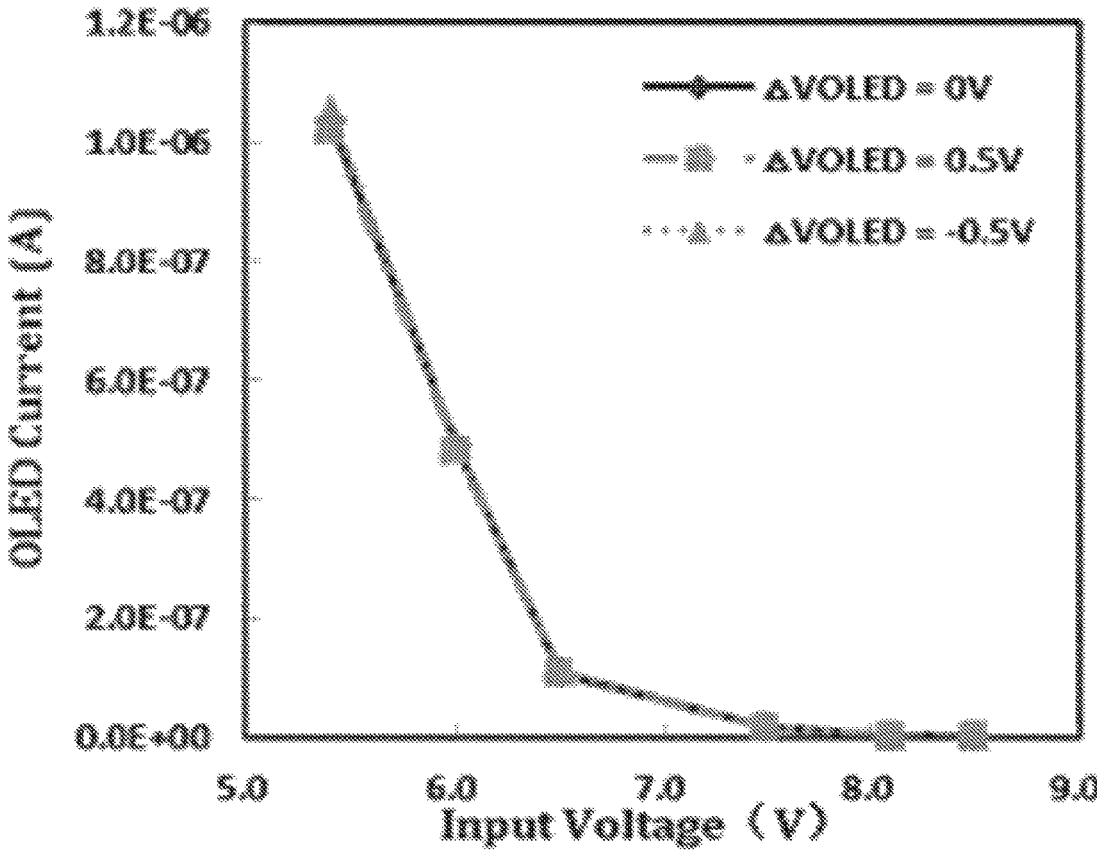
FIG. 9 is a simulation diagram of a current flowing through the OLED as the threshold voltage of the OLED in the present invention drifts.

Referring to FIG. 9, as the threshold voltage of the organic light emitting diode OLED respectively drifts 0V, +0.5V, and −0.5V, the change of the current flowing through the organic light emitting diode OLED will not exceed 6%, which effectively ensures the light emitting stability of the organic light emitting diode OLED to make the brightness of the AMOLED more even.

In conclusion, the present invention provides an AMOLED pixel driving circuit and a pixel driving method, which utilizes the 5T1C structure pixel driving circuit to implement compensation to the threshold voltage of the drive thin film transistor and the threshold voltage of the organic light emitting diode in each of the pixels. The writing of the data signal and compensation of the threshold voltage are simultaneously proceeded. The first, the second global signals are employed to control all the pixel driving circuits in the entire panel for effectively compensating the threshold voltage variations of the drive thin film transistor and the organic light emitting diode to make the display brightness of the AMOLED more even and to promote the display quality.

The above is a description to specific embodiments of the present invention only and the scope of the present invention is not limited thereto. For those skilled in the art, change or replacement can easily derived and are covered by the protected scope of the invention. Thus, the protected scope of the invention should go by the subject claims.

What is claimed is:

1. An active matrix organic light emitting display (AMOLED) pixel driving circuit, comprising: a first thin film transistor, a second thin film transistor, a third thin film transistor, a fourth thin film transistor, a fifth thin film transistor, a capacitor, and an organic light emitting diode;

wherein the first transistor has a gate electrically coupled to a first node, a drain electrically coupled to a second node, and a source electrically coupled to an anode of the organic light emitting diode;

the second thin film transistor has a gate electrically coupled to a second global signal, a source electrically coupled to a power supply positive voltage, and a drain electrically coupled to the second node;

the third thin film transistor has a gate electrically coupled to a first global signal, a source electrically coupled to the second node, and a drain electrically coupled to the first node;

the fourth thin film transistor has a gate electrically coupled to a scan signal, a source electrically coupled to a data signal, and a drain electrically coupled to a third node;

the fifth thin film transistor has a gate electrically coupled to the second global signal, a source electrically coupled to the third node, and a drain electrically coupled to a reference voltage;

the capacitor has a first end electrically coupled to the third node and a second other end electrically coupled to the first node; and the organic light emitting diode of which the anode is electrically coupled to the source of the first thin film transistor has a cathode electrically coupled to a power source negative voltage;

wherein the gates of the second and fifth thin film transistors are connected the same, second global signal;

wherein the first thin film transistor is a drive thin film transistor, which is shorted to operate as a diode to provide compensation to a threshold voltage thereof; and wherein the first and second ends of the capacitor are respectively in direct connection with the source of the fifth thin film transistor and the gate of the first thin film transistor through the electrical coupling thereof with the third node and the first node, and wherein in a predetermined period of time when the fourth thin film transistor is in an off condition and a low voltage level is supplied with the first global signal to the gate of the third thin film transistor to set the third thin film transistor in an off condition, the second and fifth transistor thin film transistors are simultaneously supplied with a high voltage level of the second global signal to the gates thereof to be both set in an on condition, so that the third node is written with the reference voltage and the first node that is directly connected to the gate of the first thin film transistor allow a voltage of the gate of the first thin film transistor to be coupled by the capacitor with the reference voltage to meet the following condition:

$$V_G = VSS + V_{th_T1} + V_{th_OLED} + V\text{ref} - V_{Data}$$

and wherein a voltage of the source of the first thin film transistor is set as follows:

$$V_s = VSS + V_{th_OLED} + f(\text{Data})$$

where $V_G$ represents a voltage of the first node, which is the voltage of the gate of the first thin film transistor and $V_{Data}$ represents a voltage of a data signal, $V_S$ represents the voltage of the source of the first thin film transistor, and f(Data) represents a function related to the data signal.

2. The AMOLED pixel driving circuit as claimed in claim 1, wherein the first thin film transistor, the second thin film transistor, the third thin film transistor, the fourth thin film transistor, and the fifth thin film transistor are each one of a low temperature poly-silicon thin film transistor, an oxide semiconductor thin film transistor, and a amorphous silicon thin film transistor.

3. The AMOLED pixel driving circuit as claimed in claim 1, wherein the first global signal and the second global signal are generated by an external sequence controller.

4. The AMOLED pixel driving circuit as claimed in claim 1, wherein the first global signal, the second global signal, and the scan signal are provided such that different combinations of the first global signal, the second global signal, and the scan signal are supplied in an initialization stage, a data writing stage, a threshold voltage compensation stage, and a drive stage of an operation of the AMOLED pixel driving circuit, wherein the data writing stage and the threshold voltage compensation stage are performed simultaneously after the initialization stage and before the drive stage to simultaneously carry out writing of the data signal and compensation of the threshold voltage;

wherein in the initialization stage, the first global signal is a high voltage level and the second global signal is a high voltage level;

in the data writing stage and the threshold voltage compensation stage, the first global signal is a high voltage level, the second global signal is a low voltage level, and the scan signal provides a pulse signal in a row by row fashion; and in the drive stage, which covers the predetermined period of time, the first global signal is of a low voltage level that is supplied to the gate of the third thin film transistor and the second global signal is of a high voltage level that is supplied to the gates of both the second and fifth thin film transistors.

5. The AMOLED pixel driving circuit as claimed in claim 1, wherein a plurality of the AMOLED pixel driving circuits are aligned in array having multiple rows and multiple columns in a display panel, wherein for each of the rows, the AMOLED pixel driving circuits of the row are electrically coupled to a scan signal input circuit that provides the scan signal and a reference voltage input circuit that provides the reference voltage via one common scan signal line and one common reference voltage line, respectively; and for each of the columns, the AMOLED pixel driving circuits of the column are electrically coupled to an image data input circuit that provides the data signal via one common data signal line; and each of the AMOLED pixel driving circuits is electrically coupled to a first global signal control circuit that provides the first global signal and a second global signal control circuit that provides the second global signal.

6. The AMOLED pixel driving circuit as claimed in claim 1, wherein the reference voltage is a constant voltage.

7. An active matrix organic light emitting display (AMOLED) pixel driving circuit, comprising: a first thin film transistor, a second thin film transistor, a third thin film transistor, a fourth thin film transistor, a fifth thin film transistor, a capacitor, and an organic light emitting diode;

wherein the first transistor has a gate electrically coupled to a first node, a drain electrically coupled to a second node, and a source electrically coupled to an anode of the organic light emitting diode;

the second thin film transistor has a gate electrically coupled to a second global signal, a source electrically coupled to a power supply positive voltage, and a drain electrically coupled to the second node;

the third thin film transistor has a gate electrically coupled to a first global signal, a source electrically coupled to the second node, and a drain electrically coupled to the first node;

the fourth thin film transistor has a gate electrically coupled to a scan signal, a source electrically coupled to a data signal, and a drain electrically coupled to a third node;

the fifth thin film transistor has a gate electrically coupled to the second global signal, a source electrically coupled to the third node, and a drain electrically coupled to a reference voltage;

the capacitor has a first end electrically coupled to the third node and a second other end electrically coupled to the first node; and the organic light emitting diode of which the anode is electrically coupled to the source of the first thin film transistor has a cathode electrically coupled to a power source negative voltage;

wherein the gates of the second and fifth thin film transistors are connected the same, second global signal;

wherein the first thin film transistor is a drive thin film transistor, which is shorted to operate as a diode to provide compensation to a threshold voltage thereof;

wherein the first and second ends of the capacitor are respectively in direct connection with the source of the fifth thin film transistor and the gate of the first thin film transistor through the electrical coupling thereof with the third node and the first node, and wherein in a predetermined period of time when the fourth thin film transistor is in an off condition and a low voltage level is supplied with the first global signal to the gate of the third thin film transistor to set the third thin film transistor in an off condition, the second and fifth transistor thin film transistors are simultaneously supplied with a high voltage level of the second global signal to the gates thereof to be both set in an on condition, so that the third node is written with the reference voltage and the first node that is directly connected to the gate of the first thin film transistor allow a voltage of the gate of the first thin film transistor to be coupled by the capacitor with the reference voltage to meet the following condition:

$$V_G = VSS + V_{th_T1} + V_{th_OLED} + V\text{ref} - V_{Data}$$

and wherein a voltage of the source of the first thin film transistor is set as follows:

$$V_s = VSS + V_{th_OLED} + f(\text{Data})$$

where $V_G$ represents a voltage of the first node, which is the voltage of the gate of the first thin film transistor and $V_{Data}$ represents a voltage of a data signal, $V_S$ represents the voltage of the source of the first thin film transistor, and f(Data) represents a function related to the data signal;

wherein the first thin film transistor, the second thin film transistor, the third thin film transistor, the fourth thin film transistor, and the fifth thin film transistor are each one of a low temperature poly-silicon thin film transistor, an oxide semiconductor thin film transistor, and a amorphous silicon thin film transistor; and wherein the first global signal and the second global signal are generated by an external sequence controller.

8. The AMOLED pixel driving circuit as claimed in claim 7, wherein the first global signal, the second global signal, and the scan signal are provided such that different combinations of the first global signal, the second global signal, and the scan signal are supplied in an initialization stage, a data writing stage, a threshold voltage compensation stage, and a drive stage of an operation of the AMOLED pixel driving circuit, wherein the data writing stage and the threshold voltage compensation stage are performed simultaneously after the initialization stage and before the drive stage to simultaneously carry out writing of the data signal and compensation of the threshold voltage;

wherein in the initialization stage, the first global signal is a high voltage level and the second global signal is a high voltage level;

in the data writing stage and the threshold voltage compensation stage, the first global signal is a high voltage level, the second global signal is a low voltage level, and the scan signal provides a pulse signal in a row by row fashion; and in the drive stage, which covers the predetermined period of time, the first global signal is of a low voltage level that is supplied to the gate of the third thin film transistor and the second global signal is of a high voltage level that is supplied to the gates of both the second and fifth thin film transistors.

9. The AMOLED pixel driving circuit as claimed in claim 7, wherein a plurality of the AMOLED pixel driving circuits are aligned in array having multiple rows and multiple columns in a display panel, wherein for each of the rows, the AMOLED pixel driving circuits of the row are electrically coupled to a scan signal input circuit that provides the scan signal and a reference voltage input circuit that provides the reference voltage via one common scan signal line and one common reference voltage line, respectively; and for each of the columns, the AMOLED pixel driving circuits of the column are electrically coupled to an image data input circuit that provides the data signal via one common data signal line; and each of the AMOLED pixel driving circuits is electrically coupled to a first global signal control circuit that provides the first global signal and a second global signal control circuit that provides the second global signal.

10. The AMOLED pixel driving circuit as claimed in claim 7, wherein the reference voltage is a constant voltage.

* * * * *